US007520219B2

(12) United States Patent
Cowan

(10) Patent No.: US 7,520,219 B2
(45) Date of Patent: Apr. 21, 2009

(54) METHOD FOR FOIL TRANSFER PRINTING ON A GARMENT IN A SCREEN PRINTER

(75) Inventor: Malcolm Cowan, Braeside (AU)

(73) Assignee: Reefdale Pty Ltd, Victoria (AU)

( * ) Notice: Subject to any disclaimer, the term of this patent is extended or adjusted under 35 U.S.C. 154(b) by 93 days.

(21) Appl. No.: 11/592,206

(22) Filed: Nov. 3, 2006

(65) Prior Publication Data

US 2007/0101876 A1 May 10, 2007

(30) Foreign Application Priority Data

Nov. 4, 2005 (AU) ..... 2005906088

(51) Int. Cl.
*B41F 15/12* (2006.01)

(52) U.S. Cl. ..... 101/129; 101/115; 101/126

(58) Field of Classification Search ..... 101/114, 101/115, 126, 129
See application file for complete search history.

(56) References Cited

U.S. PATENT DOCUMENTS 3,795,189 A 3/1974 Jaffa
3,979,248 A 9/1976 Kussmaul
4,386,993 A 6/1983 Matsuo
4,963,208 A 10/1990 Muncy et al.
5,031,527 A 7/1991 Eppinger
5,435,883 A 7/1995 Myers
5,474,633 A 12/1995 Myers
5,970,874 A 10/1999 Bill
6,053,101 A * 4/2000 Hix ..... 101/126
6,983,690 B2 1/2006 Eppinger et al.

* cited by examiner

*Primary Examiner*—Leslie J Evanisko
(74) *Attorney, Agent, or Firm*—Connolly Bove Lodge & Hutz LLP

(57) ABSTRACT

A method of transfer printing from a web of foil or flock onto a garment mounted on the pallet of a rotary screen printing machine. A heat press machine with a web feed attachment mounted on the upper platen of the heat press is provided at one printing station of a rotary screen printing machine. The foil feed direction is in the same direction as the direction of rotation of the rotary printing machine. A pallet with a garment is brought into register with the heat press and the upper platen is lowered to apply the transfer to said garment. The upper platen is raised and the printing machine is indexed so that the pallet arms are rotated and the next pallet with a garment is brought into register with the heat press. The foil web is also indexed so that the next sequential foil area is in register with the garment on the pallet.

1 Claim, 3 Drawing Sheets

METHOD FOR FOIL TRANSFER PRINTING ON A GARMENT IN A SCREEN PRINTER

This invention relates to a heat press for transfer printing of garments from foil particularly in association with a rotary screen printing machine.

BACKGROUND TO THE INVENTION

Heat presses for transfer printing are known. U.S. Pat. No. 4,386,993 discloses a press in which the upper platen moves relative to the lower platen by way of a cam and rocking member.

U.S. Pat. No. 3,979,248 discloses a decal press with a motor driven upper platen.

U.S. Pat. No. 5,435,883 discloses a hand operated press with adjustment for the gap between the platens.

U.S. Pat. No. 5,474,633 discloses a press with a pneumatic engager to press the upper platen onto the lower platen and a timer mechanism.

U.S. Pat. No. 4,963,208 discloses a system for applying a decorative device using a swingable upper platen.

Often transfers are applied as part of a process of screen printing an ornamental pattern onto a garment. The heat press is positioned relative to one print station of a rotary printing machine of the type described in U.S. Pat. Nos. 3,795,189 and 5,031,527 which are examples of the type of machines used in screen printing garments. The garment is supported on a pallet of the screen printing machine and the pallet arm swings the pallet with the garment into position between the upper and lower platens of the heat press. U.S. Pat. No. 5,970,874 and U.S. application Ser. No. 10/814,628 disclose presses adapted for rotary screen printing machines.

Foil or flock printing requires the glue to be printed on to the garment and then the foil is applied by heat and pressure and then the backing sheet removed to reveal the foil adhered only to the sections printed with the glue. The appropriate size of foil needs to be cut from the web and placed on the garment prior to treatment with the heat press. The prior art presses are not able to automatically print foil from continuous carrier webs. Flock printing is usually applied by using electrostatic attraction to the glue surface although application from a web of lightly adhered flock is possible although the appropriate sized sheet needs to be cut from the web as with foil printing.

It is an object of this invention to provide a more convenient way of applying foil or flock using a heat press.

BRIEF DESCRIPTION OF THE INVENTION

To this end the present invention provides a method of transfer printing from a web of foil or flock onto a garment mounted on the pallet of a rotary screen printing machine which includes the steps of a) providing a heat press machine with a web feed attachment mounted on the upper platen of the heat press at one printing station of a rotary screen printing machine
b) bringing a pallet with a garment into register with the heat press
c) lowering the upper platen and applying the heat and pressure adhere the foil or flock to said garment
d) raising the upper platen
e) indexing the printing machine so that the pallet arms are rotated and the next pallet with a garment is brought into register with the heat press
f) indexing the web so that the next sequential transfer area is in register with the garment on the pallet wherein the foil feed direction is the same direction as the direction of rotation of the rotary printing machine.

The web feeder is preferably attached to the fixed head of the heat press to which the upper platen is attached.

Preferably the platen frame is C shaped and the upper platen is fixed to the top of the C and the lower platen is able to be raised toward the upper platen. The C frame and the upper and lower platens are supported by a support frame which may include hydraulic or pneumatic lifting rams to initially place the C frame around the pallet of the screen printing machine. Once the heat press is actuated the lower platen is raised to contact the pallet arm and the C frame is allowed to slide downwardly so that the upper platen contacts the garment on the pallet.

The upper platen is heated to assist the transfer printing.

The web feeder consists of a frame adapted for attachment to the upper C frame of the heat press. The web feeder frame carries a web dispensing roll, a web take up roll and including web guides and a web drive roll arranged to convey the web past the heated platen of the heat press. The controller for the heat press includes a program for controlling the motor for the drive roll of the web feeder. The interval during which the motor operates is timed to correspond to moving the length of the web required to bring the next portion into register with the pallet. It is an Important insight that in operating the web feeder that the timing of the commencement of the drive roll coincides with the commencement of the index rotation of the pallet of the screen printing machine. After pressing the web remains attached to the garment and the peeling of the web from the garment is initiated by the movement of the pallet and the web.

DETAILED DESCRIPTION OF THE INVENTION

A preferred form of the invention is illustrated in the enclosed drawings in which FIG. 1 is a front view of the web feeder of this invention;

The embodiment illustrated is mounted on a mobile heat press station of the kind described in U.S. Pat. No. 5970874 and U.S. Pat. No. 6,983,690 which may be used with a rotary or oval screen printing machine of the kind described in U.S. Pat. Nos. 5031527, 5595113, 5678482 and 5913264 or any other printing machine with a cantilevered pallet.

Figure 1:
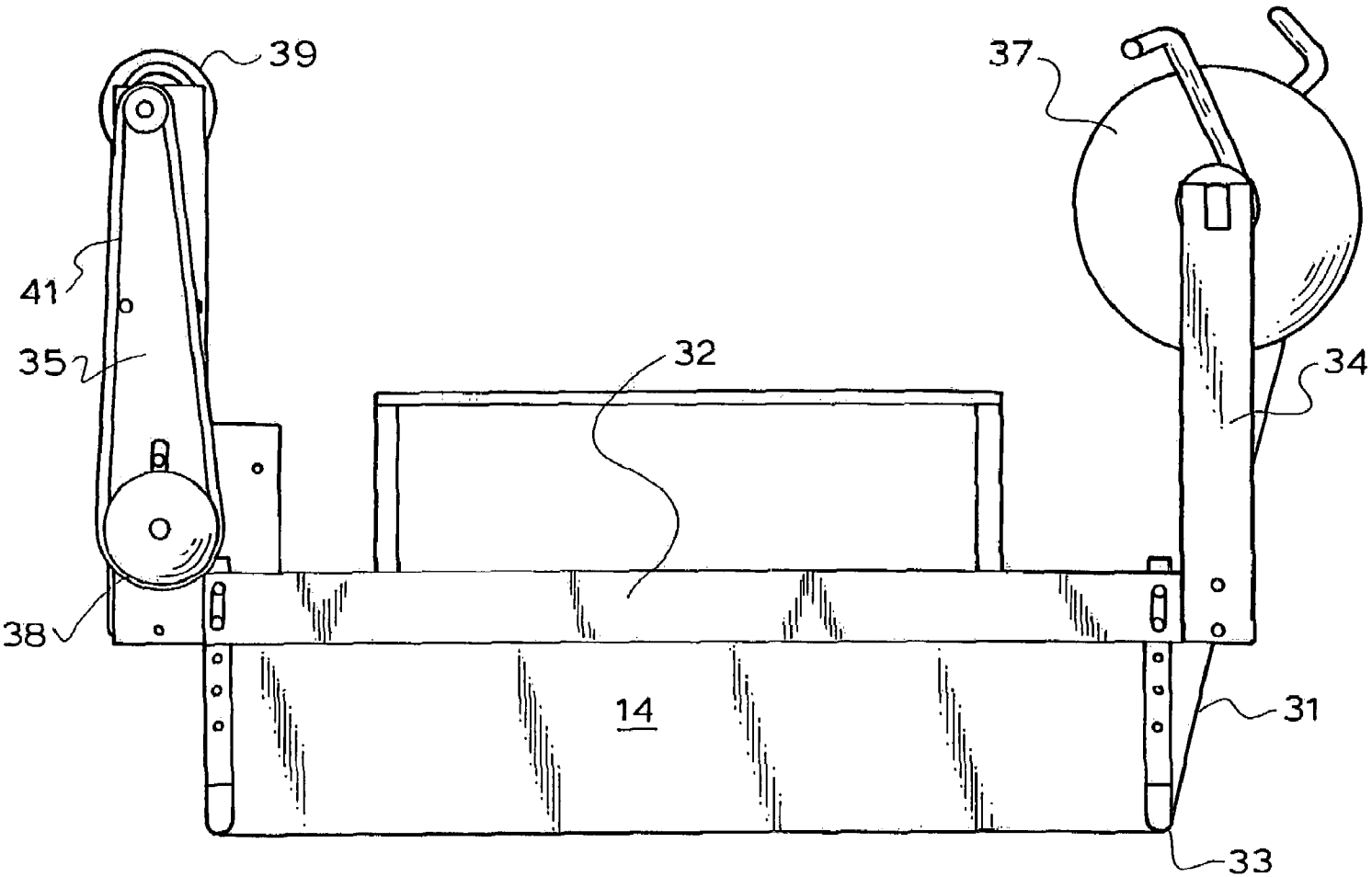
Figure 2:
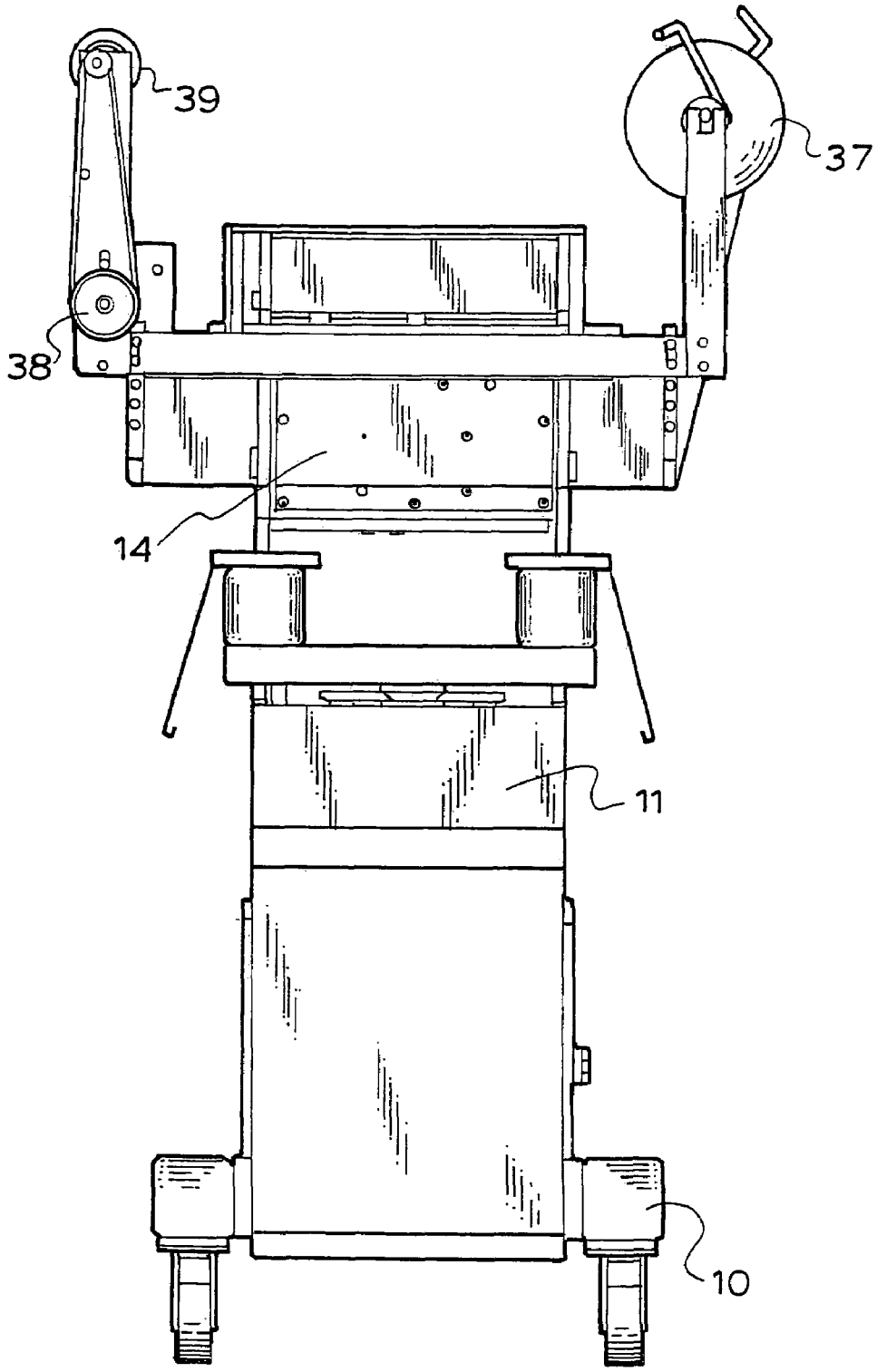
FIG. 2 is front view of the web feeder of this invention mounted on a heat press.
Figure 3:
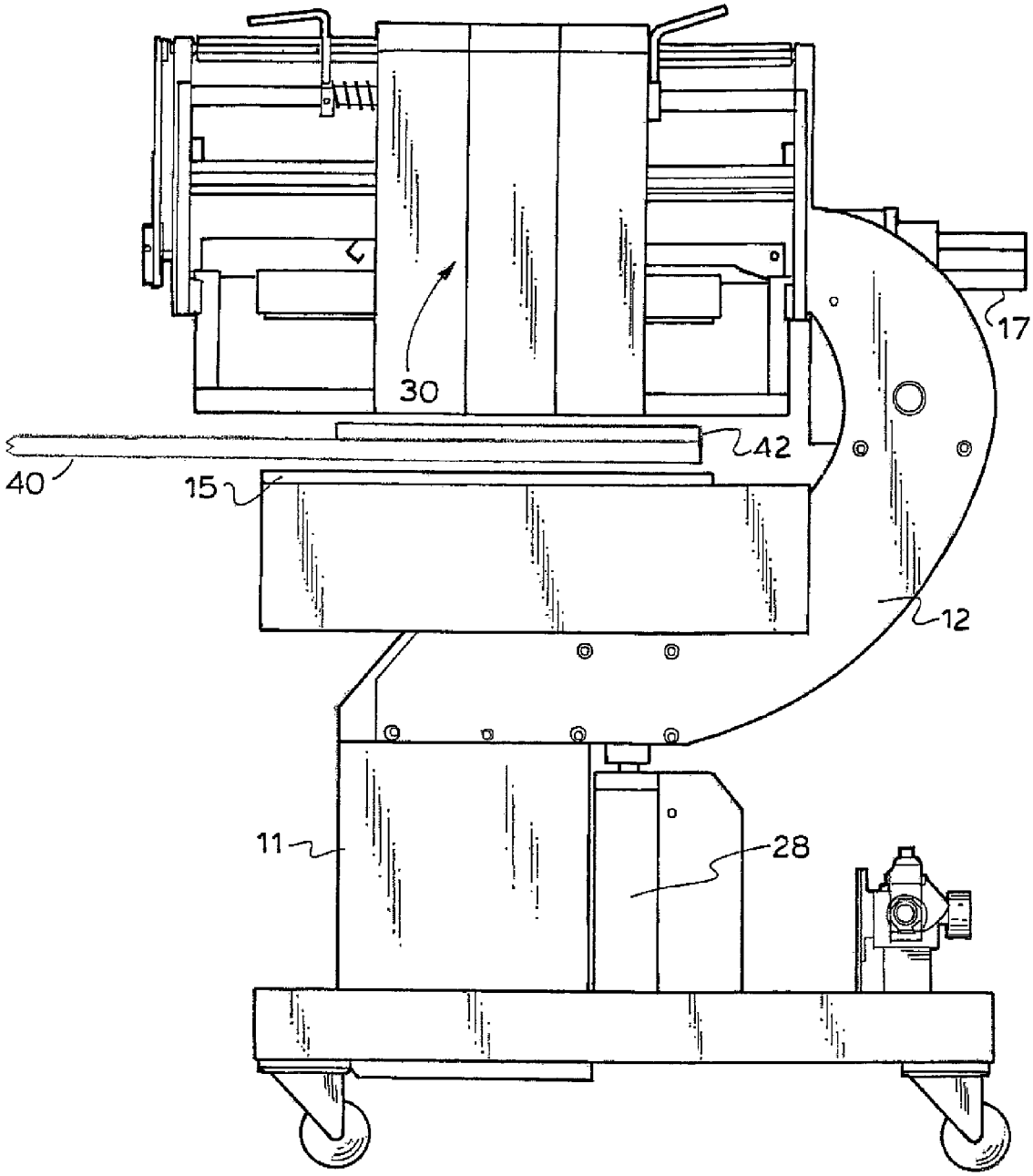
FIG. 3 is a side elevation of the web feeder of this invention.

The heat press as shown in FIGS. 2 and 3 is the same as that disclosed in U.S. Pat. No. patent 6,983,690 and consists of a wheeled base 10 mounted on which is the support frame 11. The C frame 12 is mounted for vertical sliding movement on the support 11 and carries the heater platen 14 which is the upper platen and the pallet support or lower platen 15. The heat press is located against the print station of a print machine so that each pallet will be aligned with the upper platen 14 and lie between the platens 14 and 15. The heat press includes a micro controller and controls 17 that can be programmed as to the duration and temperature of the transfer printing operation. During operation of the heating press, the heating platen 14 does not move relative to the C frame 12.

Attached to the C frame a press cylinder which is adapted to raise and lower the pallet support platen 15. The C Frame 12 is supported by the levelling cylinder 28 which in turn is fixed to the base 10. The cylinder 28 allows the C frame 12 and its attachments the upper platen 14 and the lower platen and an associated non illustrated press cylinder to float downwardly as the lower platen is raised. The levelling cylinder 28 may be an hydraulic cylinder but is preferably a pneumatic ram.

The web feeder 30 is mounted on the frame 12 above the upper platen 14 so that the web 31 is below the upper platen and above the garment bearing pallet of the screen printing machine. The frame 32 of the web feeder is secured to the heat press frame 12 and supports the two upright support frames 34 and 35. The frame 34 supports the web dispensing roll 37 and the frame 35 supports the drive roll 38 and the web take up roll 39. The belt 41 drives the foil take up roll and is able to slip to accommodate the difference in diameter as the web roll is taken up on the take up roll 39. The web 31 may be a web carrying foil or flock that can be transferred to a glued surface under heat and pressure. The web 31 is spaced from the frame and is in contact with the upper platen 14 by means of the adjustable foil guides 33. The drive roll 38 is driven by an electric motor with a controller that can be linked to the heat press controller. The drive roller pulls the web in the same direction as the rotation of the pallet on the screen printing machine. The heat press controller contains a programmable timer so that the operator can time the motor and the rotation of the drive roll to advance the web the distance required to cover the area of the glue design on the garment. In operation the leveling cylinder 28 is pressured to ensure that the pallet 42 of the rotary screen printing machine is located underneath the platen 14 and above the pallet support 15 as shown in FIG 3. When the pressing operation commences the press cylinder raises the lower pallet 15 so that it abuts and supports the pallet 42 and pallet arm 40. The air in the pneumatic cylinder 28 is allowed to bleed so that the cylinder 28 acts as a spring and takes the weight of the C frame 12 and its attachments. This means that the full weight of the C frame 12, the platens 14 and 15 and the web feeder is countered by the leveling cylinder 28 while the pallet is supported by an associated press cylinder.

The sequence of operation of the heat press and foil feeder when used in conjunction with a rotary screen printing machine is:

1. The foil or flock web is tensioned using the foil guides 33 so that it is positioned at a height just above the garment on pallet and in contact with the top platen
2. The pallet of the rotary screen printing machine swings into position between the web and bottom (support) platen
3. the pallet is raised by the rotary screen printing machine mechanism and contacts the web
4. the lower platen is raised to contact the pallet
5. the bleeding of air from cylinder 28 means that the frame and top platen are counterbalanced by the lower platen
6. heat is applied to the web and the garment on the pallet by the top platen
7. the bottom platen is lowered
8. the pallet is lowered and the web under tension remains lightly attached to the garment
9. the pallet swings out and the next pallet swings in to repeat the cycle
10. the signal from the indexer on the screen printing machine triggers the controller on the heat press to start the motor on the drive roll 38 so that the pallet and the web are moving at the same moment and in the same direction and this starts the peeling of the web from the garment so that the foil or flock remains adhered to the glue pattern on the garment
11. the motor runs for the interval programmed into the heat press controller to advance the web the required distance.

For best results it is usually preferred to screen print the glue at the print head immediately prior to the heat pressing station so that the glue doesn't cure too early when the pallets are warm. Usually the dwell time for the upper platen to be in contact with the web and the garment is of the order of 1.5 seconds.

Temperatures are usually about 160° C. and this is maintained for about 6 seconds and the pressure is about 2-3 bar.

From the above it can be seen that the present invention provides a unique and convenient means of applying foil and flock in screen printing. The number of operators required is reduced to one person and there is no need to cut and place the foil or flock sheets.

Those skilled in the art will realize that other embodiments of the invention are possible without departing from the essential principle of this invention.

The invention claimed is:

1. A method of transfer printing from a web of foil or flock onto a garment mounted on a pallet of a rotary screen printing machine which includes the steps of:

a) providing a heat press machine with a web feed attachment mounted on an upper platen of the heat press at one printing station of the rotary screen printing machine;

b) bringing a pallet with a garment into register with the heat press machine;

c) lowering the upper platen and applying the heat and pressure to adhere the foil or flock to said garment;

d) raising the upper platen;

e) indexing the printing machine so that pallet arms of the printing machine are rotated and the next pallet with a garment is brought into register with the heat press machine;

f) indexing the web so that a next sequential transfer area is in register with the garment on the pallet;

wherein the foil feed direction is the same direction as the direction of rotation of the rotary printing machine.

* * * * *